United States Patent [19]

McGugan

[11] 3,950,125

[45] Apr. 13, 1976

[54] BURNERS

[75] Inventor: John Drummond McGugan, Gorleston, England

[73] Assignee: Noralco Overseas, Inc., Metairie, La.

[22] Filed: May 23, 1974

[21] Appl. No.: 473,068

[52] U.S. Cl. ..... 431/352; 431/4; 431/183; 431/187; 239/401; 239/404; 239/417; 239/425.5

[51] Int. Cl.[2] ..... F23D 15/02

[58] Field of Search ..... 431/183, 202, 351, 352, 431/187; 239/290, 401, 403–406, 410, 412, 416, 417, 424, 425.5

[56] References Cited

UNITED STATES PATENTS

| | | | |
|---|---|---|---|
| 541,074 | 6/1895 | Dandison | 239/417 |
| 1,885,067 | 10/1932 | Woodeson | 239/403 |
| 3,074,231 | 1/1963 | Klein | 239/417 |
| 3,565,562 | 2/1971 | Drivet | 239/404 |
| 3,695,820 | 10/1972 | Hawkes et al. | 239/417 |
| 3,797,992 | 3/1974 | Straitz | 431/351 |
| 3,807,932 | 4/1974 | Dewald | 431/202 |
| 3,833,337 | 9/1974 | Desty et al. | 431/202 |

FOREIGN PATENTS OR APPLICATIONS

| | | | |
|---|---|---|---|
| 511,213 | 9/1920 | France | 239/417 |
| 18,359 | 1912 | United Kingdom | 239/404 |

*Primary Examiner*—Carroll B. Dority, Jr.
*Attorney, Agent, or Firm*—Hane, Baxley & Spiecens

[57] ABSTRACT

A burner for burning crude or contaminated oil comprises a body defining a bore open at both ends, at one of which the oil is burnt, air being drawn into the flame through the bore, and an annular oil inlet in the bore wall such that air flowing through the bore to the flame will draw oil from the inlet in atomised form, will mix with it and will carry it into the flame. The burner is surrounded by an annular water ring provided with nozzles for spraying water into the flame.

21 Claims, 2 Drawing Figures

BURNERS

The present invention relates to burners, particularly but not exclusively for burning crude or contaminated oil, for example on board a drilling rig.

According to one aspect of the present invention there is provided a burner for fluid fuel comprising a body defining a bore open at both ends and an annular chamber surrounding the bore, having an inlet for fluid fuel and outlet means for fluid fuel opening into the bore and extending circumferentially around the bore, wherein, in operation, fluid fuel and air mixture is burnt adjacent one end of the bore, air being drawn into the bore from the other end thereof and drawing fluid fuel from the chamber through the outlet means.

Advantageously the outlet means has the form of an opening extending continuously circumferentially of the bore and is variable.

According to another aspect of the present invention there is provided a burner for fluid fuel comprising a body having a bore open at both ends and adjacent one of which fluid fuel will be burnt, the body comprising a first part and a second generally tubular part which in part defines the bore and is axially slidable relative to the first part, a chamber for fluid fuel being defined between the first and second parts, having an inlet for fluid fuel and communicating with the bore through an outlet opening between the first and second parts, a surface on the second part extending radially outwardly thereof and defining a radial wall of the chamber such that the pressure of fluid in the chamber will exert on said surface a force urging the second body relative to the first body in a direction to increase the axial extent of the outlet opening, and biassing means for moving the second body in a direction to decrease the axial extent of the outlet opening.

According to a further aspect of the present invention there is provided a burner assembly comprising a burner as above-described and a hollow annular member for water, surrounding the burner adjacent the one end and having an inlet and outlet means for directing water against a flame established adjacent the one end of the body.

Figure 1:
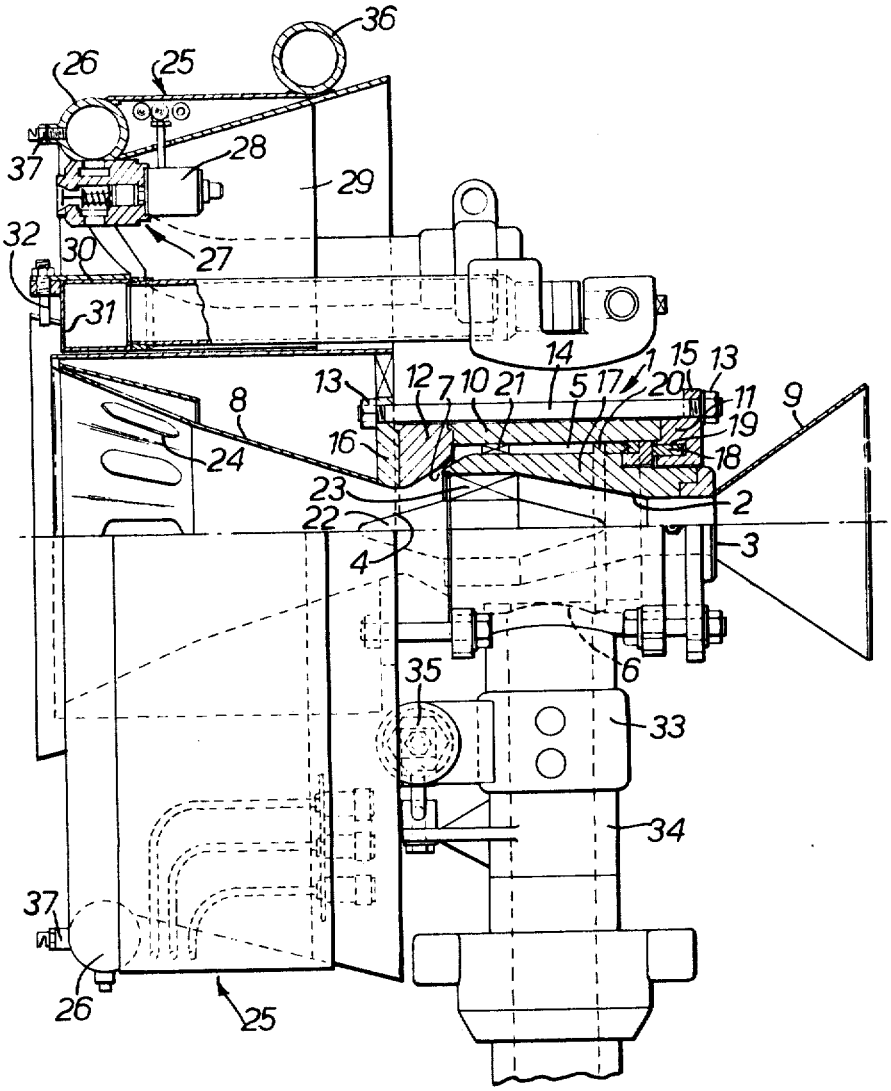
Figure 2:
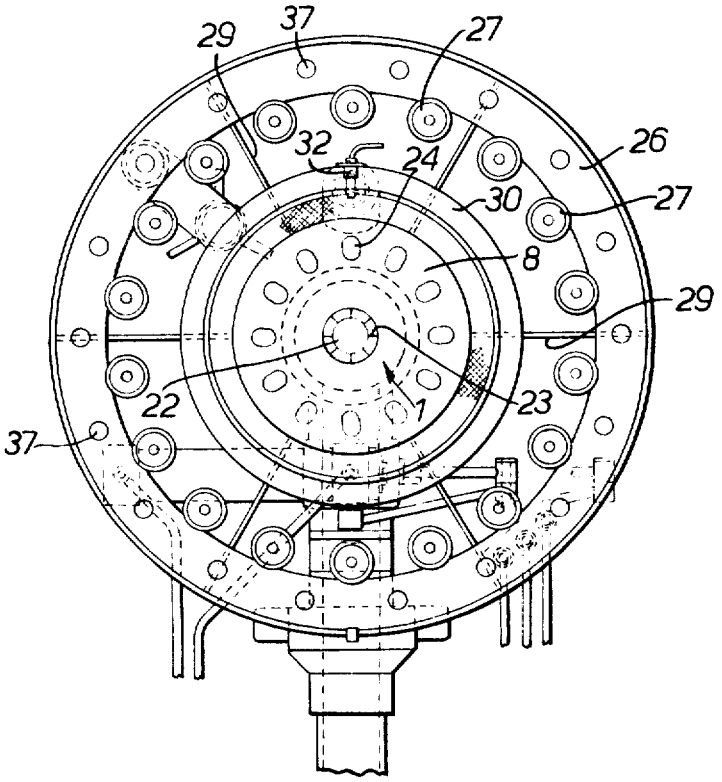

The present invention will be more fully understood from the following description of embodiment thereof, given by way of example only, with reference to the accompanying drawings, in which:

FIG. 1 is a view of an embodiment of burner assembly according to the present invention and shown partly in section; and FIG. 2 is an end view of the burner assembly of FIG. 1.

As shown in the drawings, the burner comprises a body 1 having a generally circular section bore 2 open at both ends 3, 4 and defining an annular chamber 5 for fluid fuel, e.g. crude or contaminated oil, having an inlet 6 and an outlet 7 opening into the bore 2 and extending continuously circumferentially thereof.

During operation of the burner, a flame is established adjacent the free end of a member 8 having a frusto-conical bore therethrough and mounted on the end 4 of the body 1. Air is drawn by the flame into the bore 2 of the body through a second member 9 having a frusto-conical bore therethrough and mounted on the end 3 of the body 1. In passing the fuel outlet 7, the air draws fuel in atomized form from the outlet and the mixture of air and fuel flows through the member 8 to the flame.

The body is formed by two parts, the first part comprising annular intermediate and end members 10, 11 and 12, held together by nuts 13 and bolts 14 extending between a flange 15 on end member 11 and an annular plate 16 placed against the end 4 of the body 1. The second part of the body 1 comprises an inner annular member 17 received by the intermediate and end members 10 to 12. The fuel chamber 5 is defined between the inner, intermediate and end members 17, 10 and 12 and the fuel outlet 7 between the inner and end members 17, 12. The inner member 17 is slidable axially relative to the end member 12 to vary the dimensions of the fuel outlet 7 and is biassed in a direction to close the outlet 7 by an annular piston and cylinder assembly formed by a piston 18, bearing against the inner member, which is received by a cylinder 19 formed in the end member 11 and connected to a hydraulic supply (not shown). In use, the inner member 17 is biassed in a direction to open the outlet 7 by the pressure of fuel in the chamber 5 acting against a flange 20 on the inner member and forming the end radial wall of the chamber 5. In operation the pressure of the hydraulic fluid in cylinder 19 is varied in dependence on the incoming fuel pressure to adjust the dimensions of the outlet 7 to obtain the required degree of atomization of the fuel as it is drawn from the outlet. At the end of operation, the pressure in the cylinder 19 is increased to substantially close the outlet 7.

In a modification the cylinder and piston assembly may be replaced by a spring acting between the end and inner members 11, 17.

The inner member is supported relative to the intermediate member 10 by a flange 21 in which fuel passageways are formed. In the preferred embodiment these fuel passageways extend parallel to the axis of the bore. They may, however, extend generally helically to give the exiting fuel a swirling movement.

The bore 2 is shaped so that fuel drawn out of the outlet 7 is directed towards the axis of the bore to assist mixing of the fuel with the air. Air guide means in the form of a bullet-shaped body 22 is positioned on the axis of the bore to direct incoming air along the bore wall and across the outlet 7 to create a venturi effect at the outlet in order to draw the fuel therefrom. The body 22 is supported on the inner member 17 by angularly spaced flanges or vanes 23 which are arranged to have an inclination to the radial and axial directions in order to provide air passing therebetween with a swirling movement to assist mixing of the air and fuel.

The free end portion of the member 8 adjacent which the flame is established may be provided with openings 24 through which more air can be drawn into the flame. This additional air creates turbulence in the fuel and air mixture at the end of the member 8, which turbulence has the effect of decreasing the distance between the end of the member 8 and the flame.

The burner is surrounded by a generally cylindrical sleeve 25 which supports a hollow ring 26 having an inlet to which water is supplied and a plurality of angularly spaced nozzles 27, connected laterally of the ring and through which water leaves the ring. These nozzles spray water onto the flame in order to reduce the smoke generated thereby. The nozzles 27 may be controlled between an open and closed condition and to vary the form of the exiting water, e.g. in the form of a jet of water or of a fine spray, depending on the flame condition. To this end the nozzles may be coupled together, e.g. in groups of six, each group being individually controllable by a hydraulic operator 28.

The sleeve is supported by a plurality of angularly spaced vanes 29 which may be inclined in the radial and axial planes in order to give air flowing therebetween a swirling motion.

For igniting the burner, a hollow annular body 30 is provided around the end of the member 8, the body having a plurality of axially directed outlet holes 31 and being connected to a BOC mixer for propane or a similar gaseous fuel. A sparking plug 32 is provided adjacent the body 30. When the gas exiting from the outlet holes 31 has been ignited a ring of flame is formed about the outlet end of the member 8 which will initiate flow of air through the bore 2 of the body 1 and the drawing of fuel from the outlet 7 with the subsequent ignition of this fuel.

The assembly of the burner and water spray ring 26 is mounted on a swivel joint 33 in the main fuel inlet duct 34 for angular movement about a vertical axis so that, when the assembly is mounted on a rig, it can be aligned with the wind direction, the assembly being rotated by operation of a cylinder and piston assembly 35.

A ring 36 may be provided on sleeve 35 for lifting purposes.

Additionally, to protect the operator and the rig, the burner may be arranged to provide a radial water screen around the base of the flame. To this end a plurality of nozzles 37 are mounted on the water ring 26 and each arranged to provide a radially directed fine water spray. As shown, the nozzles 37 are equally spaced between the axially directed nozzles 27. If it is found that more water is required to be sprayed into the flame, some of the nozzles 37 can be replaced by nozzles arranged to provide an axially directed spray of water, and which supplement the spray provided by nozzles 27.

I claim:

1. A burner for fluid fuel comprising:

a body defining a bore open at both ends, said bore having, sequentially in the direction from one of said open ends to the other of said open ends, a first frusto-conical portion of increasing cross sectional area in said direction, a cylindrical portion and a second frusto-conical portion of decreasing cross sectional area in said direction, said body further defining an annular chamber surrounding said bore;

inlet means to said chamber, and outlet means from said chamber surrounding said bore and opening into said bore in the region of the junction of said cylindrical portion with said first frusto-conical portion and arranged to discharge fuel along the surface of said first frusto-conical portion to its open end;

means for supplying fluid fuel to said inlet means to said chamber; and air guide means in said bore comprising a body having a cylindrical mid-portion and tapering end portions extending co-axially of said bore with a tapering portion being in said first and second frusto-conical portions and said cylindrical mid-portion being in said cylindrical portion of said bore;

wherein, in operation, fluid fuel and air mixture is burnt adjacent said one end of said bore, air being drawn into said bore from said other end, and drawing fluid fuel from said chamber through the opening of said outlet means.

2. A burner according to claim 1, wherein the body comprises first and second parts between which the annular chamber and outlet means are defined, the outlet means having the form of an opening extending continuously circumferentially of the bore and the parts being relatively movable to vary the dimensions of the outlet opening.

3. A burner according to claim 2, including means for relatively biassing the parts in a direction to reduce the dimensions of the outlet opening, the body parts being arranged so that the pressure of fluid fuel in the chamber will bias the parts relative to each other in the opposite direction.

4. A burner according to claim 3, wherein the biassing means includes a piston and cylinder assembly connected between the first and second parts.

5. A burner according to claim 3, wherein the biassing means includes a spring acting between the first and second parts.

6. A burner assembly comprising a burner according to claim 1 and a hollow annular member for water, surrounding the burner adjacent the one end and having an inlet and outlet means for directing water against a flame established adjacent the one end of the body.

7. A burner assembly according to claim 6, wherein the outlet means of the hollow annular member have the form of a plurality of circumferentially spaced outlet nozzles arranged to direct a jet or spray of water against the flame.

8. A burner assembly according to claim 6, including means in the path of air flowing between the burner and the hollow annular member for providing the air with a non-axial component of velocity.

9. A burner assembly according to claim 8, wherein the hollow annular member is mounted on a sleeve and the means in the path of air flowing between the burner and the hollow annular member are vanes extending between the sleeve and the burner.

10. A burner according to claim 1, wherein the air guide means include angularly spaced vanes extending between said air guide means and the wall of said bore.

11. A burner according to claim 1, wherein the bore at the one end thereof is cylindrical and members are provided at each end of said body having frusto-conical bores therethrough communicating with said bore in said body, the diameters of the bores of said members increasing in directions away from said body.

12. A burner according to claim 11, wherein said member at said other end of said body is formed with openings therein for admission of additional air to the burner.

13. A burner assembly comprising a burner according to claim 12 and a hollow annular member for water, surrounding the burner adjacent the one end and having an inlet and outlet means for directing water against a flame established adjacent the one end of the body.

14. A burner assembly according to claim 13, wherein the outlet means of the hollow annular member have the form of a plurality of circumferentially spaced outlet nozzles arranged to direct a jet or spray of water against the flame.

15. A burner assembly according to claim 13, including means in the path of air flowing between the burner and the hollow annular member for providing the air with a non-axial component of velocity.

16. A burner assembly according to claim 15, wherein the hollow annular member is mounted on a sleeve and the means in the path of air flowing between the burner and the hollow annular member are vanes extending between the sleeve and the burner.

17. A burner for fluid fuel comprising:

a body having a bore open at both ends through which air flows and adjacent one of which fluid fuel will be burnt, said body comprising a first part in part defining said bore and a second part which in part defines said bore and is axially slidable relative to said first part of said body, said body further including a chamber for fluid fuel defined between said first and second parts, said chamber having an inlet for fluid fuel and an outlet opening into said bore between said first and second parts, and a radial wall provided by a radially outwardly extending surface on said second part such that the pressure of fluid in said chamber will exert on said radial wall a force urging the second part of said body relative to the first part of said body in a direction to increase the axial extent of said outlet opening; biasing means for moving said second part in a direction to decrease said axial extent of said outlet opening; and air guide means in said bore;

said bore immediately upstream relative to the direction of air flowing therethrough of said outlet opening being cylindrical and immediately downstream of said outlet opening being gradually reduced in diameter, and said air guide means comprising a body co-axial with said bore and extending into said cylindrical and reduced portions of said bore, said body of the air guide means having a tapering portion extending into said gradually reduced portion of said bore.

18. A burner according to claim 17, wherein the biassing means is a spring.

19. A burner according to claim 17, wherein the biassing means is a piston and cylinder assembly.

20. A burner according to claim 17, wherein the outlet opening extends continuously circumferentially around the bore.

21. A burner according to claim 17, wherein members are provided at each end of the bore having frusto-conical bores therethrough communicating with the bore, each frusto-conical bore having a diameter which increases in a direction away from the bore of the body.

* * * * *